United States Patent [19]

Mande et al.

[11] 4,198,625

[45] Apr. 15, 1980

[54] DUAL ALARM DETECTION ON SINGLE LOOP

[75] Inventors: Irving Mande, Westport; Robert W. Right, Huntington, both of Conn.

[73] Assignee: General Signal Corporation, Stamford, Conn.

[21] Appl. No.: 902,030

[22] Filed: May 2, 1978

[51] Int. Cl.[2] ..... G08B 29/00

[52] U.S. Cl. ..... 340/517; 340/506; 340/521

[58] Field of Search ..... 340/500, 506, 510, 517, 340/521, 541

[56] References Cited

U.S. PATENT DOCUMENTS

| | | | |
|---|---|---|---|
| 3,646,552 | 2/1972 | Fuhr | 340/517 |
| 3,702,474 | 11/1972 | Fink et al. | 340/510 |

*Primary Examiner*—Alvin H. Waring

*Attorney, Agent, or Firm*—George W. Killian; Milton E. Kleinman

[57] ABSTRACT

A circuit for distinguishing between two classes of alarms on a single loop. An alarm of a first class causes an impedance of a first predetermined value to be added in the loop; and an alarm of a second class causes a much larger additional impedance, or an open condition, to be inserted in the loop. The loop is bridged across an element of a voltage divider and, therefore, the loop characteristics, including the changed characteristics due to the impedance change in response to an alarm of either class, controls the potential of a test point of the voltage divider. Voltage comparators monitor the potential of the test point relative to control potentials, and cause relays to provide a no alarm signal, a first alarm signal, or a second alarm signal when there is no alarm condition on the loop, an alarm of the first class, or an alarm of the second class, respectively, on the loop.

18 Claims, 3 Drawing Figures

DUAL ALARM DETECTION ON SINGLE LOOP

FIELD OF THE INVENTION

The present invention relates to alarm detection and, more specifically, to a means for distinguishing between first and second types of alarms and providing a unique signal indicating each type of alarm. More particularly, the invention is directed to a structure comprising a loop circuit which has connected in series therewith first and second devices for indicating first and second types of abnormal conditions, respectively. The loop is connected to central office equipment which is capable of distinguishing which of the two types of alarm conditions has been actuated and produces an appropriate alarm indicative of the type of prevailing alarm condition.

DESCRIPTION OF THE PRIOR ART

It is known that a loop circuit may be used with a plurality of normally closed contacts in series therewith so that opening of any one of the contacts will create an open loop condition and activate an alarm at the central office. Such techniques are commonly used in both fire and security alarm systems. Another type of alarm system is disclosed in U.S. Pat. No. 3,989,908 issued Nov. 2, 1976 to Budrys and Right and assigned to the same assignee as the present invention. The last named patent discloses a means for supervising a public address system such that any fault on the line connected to the speakers in the system, or any fault within a speaker structure, could be detected at the central office and suitable corrective action taken. In order to provide the necessary supervision and audio signals, three wires, or lines, were needed between the central office and the speakers.

It has been common to provide fire alarm protection and security alarm protection of a premises by providing separate loops, each connected to a central office such that an alarm can be provided indicating the specific premise with the abnormal condition and whether the abnormal condition constitutes a fire alarm or a security alarm. However, the installation and maintenance of two loops adds to the cost of such supervision and detection system.

SUMMARY OF THE INVENTION

The present invention provides a means for distinguishing between either of two classes of alarms which may be transmitted to the central office on a single supervising loop. One class of alarm is indicated by the insertion of a resistor in series with the supervising loop. The other class of alarm is indicated by either opening the loop or inserting a much larger resistor in series with the loop. An alarm differentiating circuit at the central office comprises a potential source having an upper and lower potential limit identified arbitrarily as I and A, respectively. A first circuit means is bridged across the potential source and clamps first and second terminals at first and second predetermined intermediate potentials. For convenience in identifying the relative magnitude of these and other intermediate potentials, they will be identified as potentials B to H which increase in magnitude, with respect to A, in alphabetic sequence. The first and second clamped terminals are clamped at potentials D and G, respectively. A second circuit means which is responsive to normal conditions on the supervising circuit maintains a test terminal at a potential within the range of H to I. The said second circuit means responds to an alarm of the first class by switching the test terminal to a potential within the range E to F. And, the second circuit means responds to an alarm of the second class by switching the test terminal to a potential within the range B to C. Within the central office are potential comparing means coupled to said potential source and the said first and second terminals and said test terminal for producing first, second and third unique signals when the test terminal is within said H to I; E to F; and B to C potential range, respectively. The test terminal is caused to shift from one range to the other in response to changes in the loop condition caused by the actuation of the various classes of alarm coupled to the supervising loop. More specifically, the loop is bridged across an impedance element which comprises part of a voltage divider circuit bridged across the lower and upper potential limits of the potential source. Accordingly, any change in the loop impedance will cause the test point to shift potential. The voltage comparators compare the potential of the test point with that of the clamping points and/or with other potentials to provide a no alarm condition when no alarm exists on the loop. First and second different alarm conditions are initiated in response to alarms of a first and second class, respectively, being indicated by actuation of the different types of alarm contacts in series with the supervising loop.

It is an object of the present invention to provide a new and improved alarm indicating system.

It is a more particular object of this invention to be able to differentiate between first and second classes of alarm conditions using a single loop.

It is another object of this invention to cause a test point to fall within first, second and third non-overlapping potential ranges when no alarm condition is detected on a supervising loop, when a first class of alarm is detected on the supervising loop, and when a second class of alarm condition is detected on the supervising loop, respectively.

It is another object of this invention to provide comparator means for testing a test point which may have a potential in any one of three non-overlapping potential ranges and provide a unique output signal indicative of the specific one of the three potential ranges within which the test point falls.

Still another object of the present invention is to provide an improved dual alarm detection circuit which overcomes the disadvantages of the prior art structures and which is characterized by its reliability, ruggedness, convenience, simplicity, and low cost, together with high versatility and adaptability.

Other objects and advantages of the present invention will become more apparent by considering the following specification together with the drawing.

BRIEF DESCRIPTION OF THE DRAWING

To permit an orderly and detailed analysis of the operational characteristics of this structure and associated circuit, three figures have been provided. The drawing discloses one form of the invention and is not meant in any way to delimit the scope of the invention. The drawing is provided as an aid in an understanding of the invention and standard electrical symbols and notations have been used. To assist in an analysis of the operation of the circuit, selected elements have been assigned mnemonic designators.

DESCRIPTION OF THE PREFERRED EMBODIMENT

Figure 1:
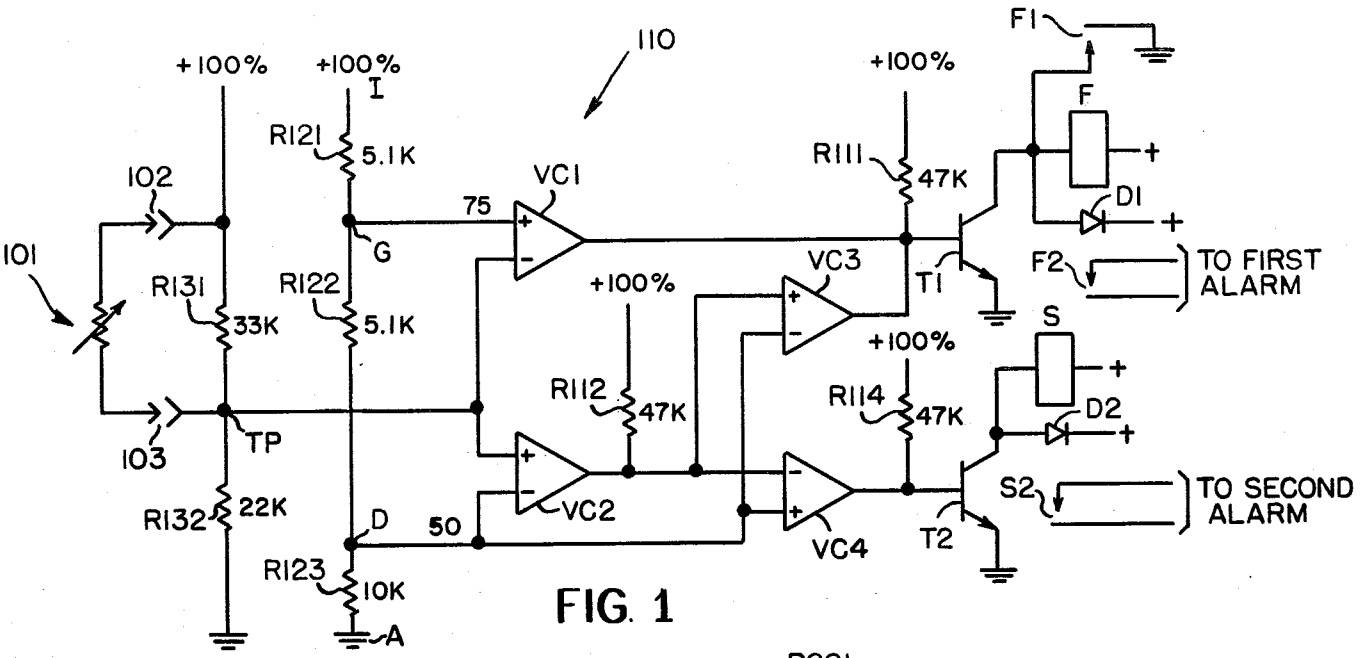
FIG. 1 comprises a schematic circuit of the central office detection and comparator circuit together with an abbreviated representation of the supervisory loop.
Figure 2:
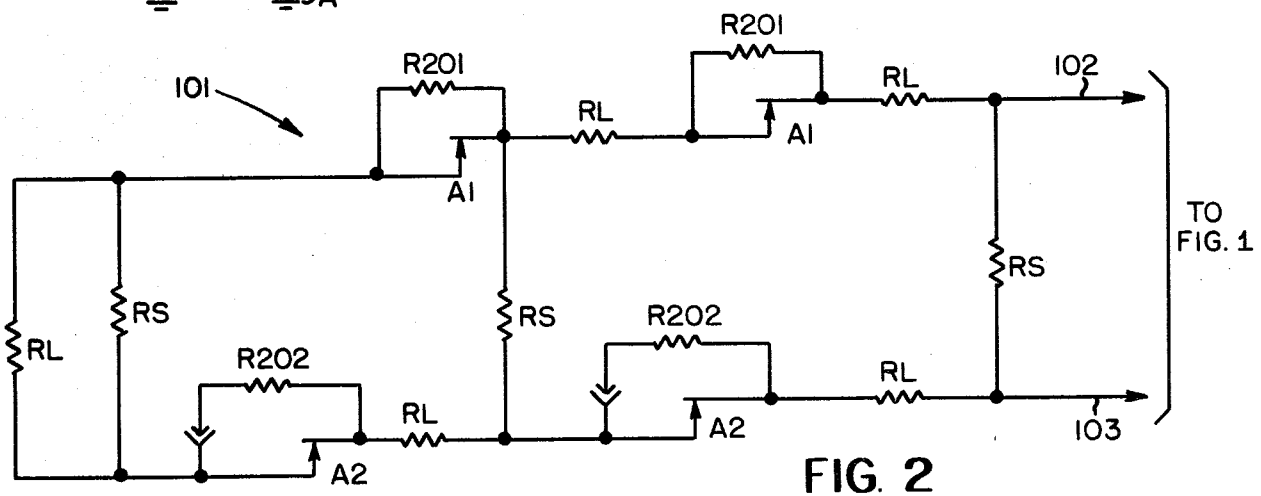
FIG. 2 illustrates the supervisory loop and includes resistors representing the inherent loop and shut resistance.

Referring now more particularly to the drawing and, in particular, to FIG. 1, there is depicted a central office test circuit indicated generally as 110 to which a loop indicated generally as 101 is coupled at terminals 102 and 103. More details of the loop circuit 101 are shown in FIG. 2. The central office test circuit 110 is coupled to a potential source which may have any of a wide variety of magnitudes depending upon the loop characteristics and/or the characteristics of the elements comprising the central office test circuit 110. Accordingly, potentials will be referred to as percentages of the applied potential. Thus the negative terminal of the potential will be zero, or ground, and the positive terminal will be referred to as 100 percent representing 100 percent of the applied potential. Thus, if the central office test circuit 110 were connected to a 24 volt potential supply, the points designated 100 percent would be at a potential of +24 volts; but herein are indicated as 100 percent. Various terminals within the central office test circuit 110 will be seen to be connected to the positive potential of the power supply and are designated +100 percent. Other terminals will be seen to be connected to the negative terminal to the power supply and are indicated with the conventional ground symbol.

The central office test circuit will be seen to comprise a plurality of voltage comparators designated VC1, VC2, VC3 and VC4. A suitable voltage comparator may comprise the quad comparator MC3302P which comprises four comparators in a single package. Other comparators are available and may be used. Each of the voltage comparators VC1 through VC4 will be seen to have positive and negative inputs indicated on the left hand side thereof and an output comprising the right hand terminal. Although not illustrated, it will be understood that ground and the 100 percent power supply potential are both connected to each voltage comparator. When the positive input of a comparator is positive with respect to the negative input, the output comprises an open circuit. When the positive input of a voltage comparator VC1 through VC4 is negative with respect to the negative input, the output terminal will be at ground potential. Coupled to the output lead of each voltage comparator will be seen a pull-up resistor R111, R112 and R114. R111 serves VC1 and VC3. Since the pull-up resistors R111, R112 and R114 are coupled to the positive power supply, the outputs of the voltage comparators VC1 through VC4 will be at the 100 percent potential at such times as the outputs are not at ground potential. That is, when the positive input of one of the voltage comparators is negative with respect to the negative input of the same comparator, the output of that comparator will be at ground potential. When the positive input of any of the comparators is positive with respect to the negative input, the output terminal will be held at the 100 percent potential by the associated one of the pull-up resistors R111, R112 and R114. For the illustrated example, the pull-up resistors R111, R112 and R114 are indicated as 47 K (forty-seven thousand) ohms. Other values of pull-up resistors could be used if desired.

Bridged across the power supply is a voltage divider including resistors R121, R122 and R123 which, for illustrative purposes, are indicated as comprising resistors of 5.1 K, 5.1 K and 10 K, respectively.

In order to describe the function of the central office test circuit 110, it will be important to consider the relative magnitudes of potential at selected points. In order to do this most conveniently, several potentials will be identified by a letter. The negative potential, or ground potential, will be referred to herein as potential A and the 100 percent potential will be referred to as I. Intermediate potentials will be referred to with any one of the letters B through H and wherein the potential difference between each letter and the ground potential increases in alphabetical sequence. That is, potential B is positive with respect to potential A and potential C is positive with respect to potential B and so on through I which is the most positive potential indicated. Simple calculations will show that with the resistors indicated, the potential at point G, which comprises the junction of resistors R121, R122 and the positive input of VC1, is at approximately 75 percent. Also, the potential at point D, which comprises the junction of resistors R122, R123 and the negative input of VC2, is at approximately 50 percent.

Another voltage divider comprising resistors R131 and R132 is bridged across the potential supply. The junction point of these two resistors comprises a test point designated TP. It will be seen that the test point TP is also coupled to the negative and positive input terminals of the voltage comparators VC1 and VC2, respectively. Considering only the values shown for the resistors R131 and R132; namely, 33 K and 22 K, respectively, the test point TP will lie at a potential of approximately 40 percent. However, as will be seen, the potential of the test point TP will be influenced by the characteristics of the loop 101 bridged across terminals 102 and 103 and hence in parallel with resistor R131.

Considering now further details of the test circuit 110, there will be seen first and second transistors designated T1 and T2, respectively. These transistors are of the NPN type and, accordingly, will not be turned on unless the base is positive with respect to the emitter. Since the emitters of the transistors T1 and T2 are coupled to ground potential, it will be seen that transistor T1 cannot be turned on whenever the output of either the voltage comparator VC1 or VC3 is at ground potential. In like manner, the transistor T2 cannot be turned on while the output of voltage comparator VC4 is at ground potential. However, if neither the voltage comparator VC1 nor VC3 has its output terminal at ground potential, the pull-up resistor R111 can provide a positive bias on the base of transistor T1 so that it will turn on. This will allow current flow from a positive potential designated plus (i.e. +), and which may or may not be the same as the positive potential I, through relay coil F and from the collector to emitter of transistor T1. This will operate the F relay. As soon as the F relay is actuated, it closes its contacts F1 which locks the F relay actuated independent of the conduction of the transistor T1. The contacts F2 of the relay F may be coupled to any suitable alarm device or devices to initiate actuation thereof. The diode D1 in parallel with the relay coil F provides a conventional spark protection circuit. A relay S which is similar to F is provided, and the circuit for the S relay will be seen to be similar to that for the F relay, except that locking contacts are not shown. It will be evident that the locking contacts may be included with either, both or neither relay as may be most convenient for the specific application. The contacts S2 couple to a suitable alarm circuit for providing a unique alarm which is distinguishable from that which is initiated by the contacts F2.

Considering now more specifically FIG. 2, there will be seen a more detailed circuit of the loop indicated generally as 101 in FIG. 1. At the right hand end of FIG. 2 are terminals 102 and 103 which connect with the corresponding terminals of FIG. 1. Thus it will be seen that the loop circuit of FIG. 2 is in parallel with resistor R131 of FIG. 1 and that the parallel combination of the loop circuit 101 and resistor R131 will control the potential of the test point TP. Any change in the loop resistance will effect the potential of the test point TP. The loop circuit 101, as seen in FIG. 2, has distributed loop resistance which is indicated schematically as a plurality of resistors designated RL. In addition, the loop 101 has a shunt resistance represented schematically as a plurality of resistors designated RS. The central office circuit 110 is designed to function with a loop having an accumulated loop resistance of up to 5,000 ohms and a shunt resistance of 100,00 ohms. Obviously, circuit modification would permit other limits. It will be evident that if a loop 101 has zero loop resistance and an infinite shunt resistance, it provides a direct short circuit on the resistor R131 and the test point TP will be at the 100 percent potential which is also designated as potential I. If the loop 101 has a maximum loop resistance of 5,000 ohms and a minimum shunt resistance of 100,000 ohms, a series of simple calculations employing Ohms law will show that the potential of the test point TP will fall at approximately the 84 percent level. This potential is designated on FIG. 3 as potential H. That is, FIG. 3 indicates relative magnitudes of various points under different circuit conditions. Point A represents the zero or ground potential, while point I indicates the maximum positive or 100 percent potential. The intermediate letters B through H represent increasing potential points with respect to point A. Thus, as may be seen, the test point TP will fall within the potential range H to I so long as the loop and shunt resistance of the loop 101 remain within the range previously indicated.

Returning now to FIG. 1, it will be seen that when the impedance of the loop 101 falls within the normal range and the potential of the test point TP is within the potential band H to I, that this potential at TP is applied to the negative and positive input terminals of the voltage comparators VC1 and VC2, respectively. Since the test point potential, under the described circumstances, is greater than the potential G applied to the positive input terminal of the voltage comparator VC1, it will be evident that the potential of the positive input terminal is negative with respect to the potential of the negative input terminal and that, therefore, the output terminal of the voltage comparator VC1 will be at ground potential and that, therefore, the transistor T1 is prevented from conducting, and the relay F will be nonoperated (assuming it had not been previously operated and locked operated through its contacts F1).

At the same time (while the loop impedance is such as to cause the potential at the test point TP to fall within the range H to I), it will be seen that the voltage comparator VC2 has a condition wherein the positive input signal is more positive than the negative input signal and that, therefore, ground is not applied to the output terminal of the voltage comparator VC2. Accordingly, the 100 percent potential from resistor R112 will be applied to the negative input of the voltage comparator VC4. And at the same time, the potential D will be applied to the positive input terminal of the voltage comparator VC4. Accordingly, the positive input terminal of the voltage comparator VC4 is negative with respect to the negative input terminal and, therefore, the output of the voltage comparator VC4 will be at ground potential and this will maintain the transistor T2 turned off. With transistor T2 turned off, the relay S cannot be activated.

In summary, when the impedance of the loop 101 has a loop resistance not exceeding 5,000 ohms and a shunt resistance no less than 100,000 ohms, the transistors T1 and T2 cannot be turned on and neither relay F nor S can be activated.

Under the same conditions already discussed, it will be seen that the I potential applied through resistor R112, and which was applied to the negative input terminal of voltage comparator VC4, is also applied to the positive input terminal of voltage comparator VC3. And, at the same time, the negative input terminal of the voltage comparator VC3 is coupled to potential D. This will cause the output terminal of the voltage comparator VC3 to go open. However, inasmuch as the voltage comparator VC1 is providing a ground output, the transistor T1 is maintained turned off independent of the condition of the voltage comparator VC3. That is, the transistor T1 cannot be turned on if either of the voltage comparators VC1 or VC3 is providing a ground output signal.

Returning to FIG. 2, there will be seen a first plurality of contacts designated A1 and a second plurality of contacts designated A2. A resistor R201 is in parallel with each normally closed contact A1. A resistor R202 is shown as optionally in parallel with each contact A2. That is, the resistor R202 may or may not be used as suits the exigencies of the particular application. The resistors R202, if used, will have an ohmic value much larger than that of resistors R201. The resistors R201 may have an ohmic value approximating 50 percent of the maximum allowable loop resistance. These resistor values may, of course, be modified to suit the exigencies of the particular application under consideration.

The contacts A1 are normally closed and are designed to open in response to a first class of abnormal condition. For example, the contacts A1 might each comprise part of a fire or smoke alarm detector so that a contact A1 may be opened in response to detection of fire or smoke. Devices of this nature are well documented in the patent and other literature and it is believed that it would only obscure the inventive concept disclosed herein to include any operative details of such alarm devices.

The normally closed contacts A2 are connected to a second class of alarm devices which respond to a different set of abnormal conditions. For example, the contacts A2 might be coupled in circuit with security contacts which are activated in response to detection of unauthorized movement in a protected area or in response to the opening of a door or window which should remain closed. The contacts A2 may be actuated to their open position by any of a wide variety of security alarm devices which are well known to those familiar with such devices and it is believed that the illustration of any further details would only tend to obscure the inventive concept shown herein. Suffice it to say that the contacts A1 open in response to a first class of abnormal condition, and the contacts A2 open in response to a second class of abnormal condition, and that in response to the opening of any one of the contacts A1, a first fixed resistor R201 is inserted in series with the loop 101; and in response to the opening of any one of the contacts A2, the loop 101 is either open circulated or a much larger resistance R202 inserted in series with the loop.

It will be evident that opening one or more of the contacts A1 will materially effect the loop impedance and that, therefore, the potential of the test point TP will be affected. If the resistors R201 have a nominal value of the order of 2.2 K, it can be shown by a simple application of Ohms law that the potential of the test point TP will fall somewhere within the potential band E to F when one of the contacts A1 is opened. If a second contact A1 should also open, the magnitude of potential E will be slightly reduced. However, by a careful choice of all resistor values, it will be possible to choose values such that potential E is greater than potential D.

With the test point TP at a potential within the potential band E to F, it will be apparent that no change has been made in any of the voltage comparators VC2, VC3 or VC4 and that, therefore, the transistor T2 is maintained in the off condition. However, with the test point having a potential within the band E to F, this potential is applied to the negative input terminal of the voltage comparator VC1 and, therefore, the positive input terminal of this voltage comparator is greater than the negative input potential and, accordingly, the output of the voltage comparator VC1 will no longer be at ground potential and will go open. Since the voltage comparator VC3 is in the same condition, no ground is applied to the base of transistor T1 and, therefore, the positive potential applied through resistor R111 is applied to the base of transistor T1 and this transistor will commence to conduct. With transistor T1 conducting, the relay F will be actuated in the manner previously described and the contacts F1 will lock the relay F operated while the contacts F2 will provide a signal to an auxiliary alarm circuit to provide a suitable indication that at least one of the contacts A1 on the loop has opened.

By a proper choice of resistor values, the same conditions may be caused to be obtained in the event that two of the contacts A1 should open simultaneously. As previously indicated, the contacts F1 are used to lock the relay F operated. If the circumstances are such that it is desired to have an intermittent alarm signal in response to an intermittent opening of one of the contacts A1, the contacts F1 on the relay F could be omitted.

Returning again to FIG. 2, consideration will now be given to the conditions which prevail if one of the contacts A2 should open. For the present, it will be assumed that a resistor R202 is not used and that the contacts A2 will merely open the loop. Under these conditions, a simple application of Ohms law will show that the resultant loop impedance, when placed in parallel with the resistor R131 of FIG. 1, will be such as to move the potential of the test point TP somewhere within the potential band of B to C.

With the potential of the test point within the potential band B to C, it will be seen that there is no change in the output of the voltage comparator VC1. However, the positive input signal applied to the voltage comparator VC2 is now negative with respect to the negative input potential and, therefore, the output of the voltage comparator VC2 will go to ground. Thus a ground potential will be applied as inputs to the positive and negative input terminals of voltage comparators VC3 and VC4, respectively. This means that the positive input terminal of the voltage comparator VC3 is negative with respect to the negative input terminal and, therefore, the output of this comparator will be at ground potential which is the same potential as the output of voltage comparator VC1, and the base of transistor T1 will be maintained at ground potential, thereby keeping the transistor T1 turned off. However, the positive input lead of the voltage comparator VC4 will be positive with respect to the ground input signal applied to the negative input lead of the voltage comparator VC4 and, therefore, ground will be removed from the output terminal of the voltage comparator VC4. In response to this action, the positive potential at the upper end of resistor R114 will be applied to the base of transistor T2 and the relay S will be allowed to operate to close contacts S2 to provide an appropriate remote alarm indicative of the actuation of one or more of the contacts A2 in the loop. It will be apparent that if a resistor R202 is used in parallel with the contacts A2, the magnitude of the limits of potential band B to C will be influenced. It will be important that all resistor values are selected to provide the relationships illustrated in FIG. 3.

One reason for using a resistor R202 is to permit use of a loop sensing circuit to distinguish between an open A2 contact and a fault condition resulting in a break in the loop.

Figure 3:
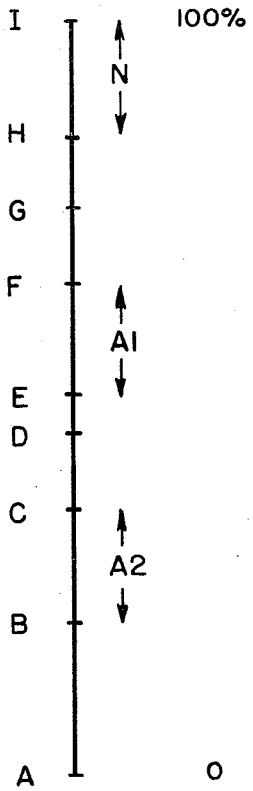
FIG. 3 comprises a representation of the relative magnitude of various potentials referred to in the specification.

Considering the operation of the circuit as explained together with FIG. 3 of the drawing, it will be seen that an important aspect of the invention resides in the fact that the resistor values, loop limits and voltage dividers are carefully selected so that the potential of the test point TP may fall in one of three well defined and non-overlapping voltage bands and that reference potentials are available at upper and lower potentials and between the potential bands. More specifically, as illustrated in FIG. 3, there are three potential bands which extend between potentials H and I; between potentials E and F; and between potentials B and C and which bands are designated N, A1, and A2, respectively. Upper and lower potentials I and A together with intermediate potentials G and D are provided.

It should be noted that a regulated power supply is not required and that the system will not be effected by a variation in supply potential because all testing depends on relative rather than absolute potential magnitudes.

In summary, it has been shown that when none of the contacts A1 or A2 of the loop circuit of FIG. 2 are opened, the potential of the test point TP will lie within the potential band H to I and neither of the relays F or S will be operated. When a first one of the contacts A1 of the test loop 101 is opened, the potential of the test point TP will lie within the potential band E to F and the relay F will be actuated to provide a first class of alarm. When one of the contacts A2 in the loop circuit 101 is opened, the potential of the test point TP will lie within the potential band B to C, thereby actuating the relay S and providing a distinctive alarm signal.

It will be apparent that if one of the alarm contacts A1 should go open, thereby actuating the relay F and creating an alarm of the first class, it will also be possible to subsequently operate one of the contacts A2 which will result in the operation of the relay S and the production of an alarm of the second class simultaneously with the locked-in alarm of the first class. However, if the first alarm condition detected is one of the class employing the contacts A2, such alarm condition will be indicated, but a subsequent opening of one of the contacts of the class A1 will not result in actuation of the F relay. Accordingly, in applying this circuit to actual conditions, consideration should be given to the relative priority of the two class of alarm and it should be recognized that an alarm of class 1 cannot be recognized subsequent to the recognition of an alarm of class 2. However, the inverse is not true. More specifically, an alarm of class A1 will be recognized and indicated and a subsequent alarm of class A2 can be detected and indicated.

If an alarm of class 2 should occur without the prior indication of an alarm of class 1 it is important to be able to operate the S relay without simultaneous operation of the F relay. That is, if one of the contacts A2 should open while all of the contacts A1 remain closed, it is desired to operate the relay S without concurrent operation of the relay F. However, in response to the opening of one of the contacts A2, it will be evident that the potential of the test point TP must fall from the potential band H to I to the potential band B to C and that in so doing the potential will pass through band E to F. While the potential of the test point is falling through the band E to F, the relay F should not be allowed to operate. This objective is achieved by the inherent inertia of the relay F which cannot operate in less than approximately 3 milliseconds and a more common average is of the order of 6 to 10 milliseconds. The time required for the potential of the test point TP to fall through the potential band E to F is of the order of only a few microseconds. Therefore, the relay F cannot be actuated in response to the opening of one of the contacts A2.

While there has been shown and described what is considered at the present to be a preferred embodiment of the invention, modifications thereto will readily occur to those skilled in the related arts. For example, different voltage levels and resistor values could be used and circuit modifications could be employed to use PNP transistors and/or voltage comparators with different characteristics. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, and it is intended to cover in the appended claims all such modifications as fall within the true spirit and scope of the invention.

What is claimed is:

1. An alarm differentiating circuit comprising in combination:

(a) a potential source having lower and upper potential limits identified herein as A and I, respectively, and intermediate potentials from B to H increasing in magnitude, with respect to A, in alphabetic sequence;

(b) first circuit means bridged across said potential source for clamping first and second terminals at potentials D and G, respectively;

(c) second circuit means responsive to a non-alarm indicating condition for maintaining a third terminal at a potential within the range of H to I;

(d) said second circuit means responsive to a first class of alarm indication for switching said third terminal to a potential within the range of E to F;

(e) said second circuit means responsive to a second class of alarm indication for switching said third terminal to a potential within the range of B to C; and (f) potential differentiating means coupled to said potential source, and said first, second and third terminals for producing first, second and third unique alarm indicating signals when said third terminal is within said H to I; E to F; and B to C potential range, respectively.

2. The combination as set forth in claim 1, wherein said potential differentiating means comprises four voltage comparators, (a) with a first one of said comparators sensing the relative potential between potential G and said third terminal;

(b) with a second one of said voltage comparators sensing the relative potential between potential D and said third terminal; and (c) with the third and fourth ones of said voltage comparators sensing the relative potential between potential D and the output of said second one of said voltage comparators.

3. The combination as set forth in claim 2, wherein said third and fourth voltage comparators produce inverse outputs relative to each other.

4. The combination as set forth in claim 3, wherein the outputs of said first and third voltage comparators are coupled together.

5. The combination as set forth in claim 4 and including first and second sensing circuits, each having first and second stable states, coupled to the outputs of said third and fourth voltage comparators, respectively, for producing one of three unique output signals indicative of the outputs of said third and fourth voltage comparators which, in turn, are indicative of the specific one of the potential H to I; E to F and B to C within which said third terminal may reside.

6. The combination as set forth in claim 5, wherein said first and second sensing circuits are both in a first one of their first and second stable states when said third terminal is in the potential range H to I.

7. The combination as set forth in claim 5 or 6, wherein said first and second sensing circuits are in said second and first stable states, respectively, when said third terminal is in the potential range E to F.

8. The combination as set forth in claim 7, wherein said first and second sensing circuits are in said first and second stable states, respectively, when said third terminal is in the potential range B to C.

9. The combination as set forth in claim 5, wherein one of said first and second sensing circuits is electrically lockable and locks into one of its stable states when triggered to that state and independent of the continuation of the condition which initiated the action.

10. The combination as set forth in claim 9, wherein said lockable sensing circuit locks in response to said third terminal declining from the potential range H to I, to the range E to F.

11. The combination as set forth in claim 10, wherein said lockable sensing circuit does not lock in response to said third terminal declining from the potential range to H to I through said range E to F to the range B to C.

12. The combination as set forth in claim 11, wherein said lockable sensing circuit includes a relay.

13. The combination as set forth in claim 1, wherein said second circuit means comprises, (a) a voltage divider bridged across said potential source and wherein a junction point of said voltage divider comprises said third terminal; and (b) a loop bridged across an element of said voltage divider for modifying the potential of said third terminal in response to a change in the impedance of said loop.

14. The combination as set forth in claim 13, wherein said loop includes first and second classes of normally closed series connected contacts for modifying the impedance of said loop in first and second manners in response to the opening of one of said first and second classes of contacts, respectively.

15. The combination as set forth in claim 14, wherein said first and second classes of series contacts modify the impedance of said loop by increasing the loop impedance.

16. The combination as set forth in claim 15, wherein a contact of said first class unshunts a first fixed impedance when opened.

17. The combination as set forth in claim 15 or 16, wherein a contact of said second class unshunts a second fixed impedance when opened.

18. The combination as set forth in claim 15 or 16, wherein the electrical continuity of said loop is broken in response to contacts of said second class opening.

* * * * *